United States Patent [19]

Myers

[11] 4,222,503

[45] Sep. 16, 1980

[54] POURING SPOUT ATTACHMENT FOR A CONTAINER

[76] Inventor: William H. Myers, 1056 Meade St., San Diego, Calif. 92116

[21] Appl. No.: 27,991

[22] Filed: Apr. 9, 1979

[51] Int. Cl.[3] ..... B65D 43/18

[52] U.S. Cl. ..... 222/508; 222/534

[58] Field of Search ..... 222/470, 471, 508, 511, 222/512, 515, 533, 534, 535, 536, 561, 556, 567, 573

[56] References Cited

U.S. PATENT DOCUMENTS

| | | | |
|---|---|---|---|
| 1,617,192 | 2/1927 | Barron | 222/561 X |
| 2,675,146 | 4/1954 | Russell | 222/561 X |
| 3,024,950 | 3/1962 | Frison | 222/533 X |
| 3,734,361 | 5/1973 | Brucker et al. | 222/556 |
| 3,887,124 | 6/1975 | Skau | 222/561 X |

FOREIGN PATENT DOCUMENTS

| | | | |
|---|---|---|---|
| 2304544 | 10/1976 | France | 222/535 |

*Primary Examiner*—Robert J. Spar
*Assistant Examiner*—Edward M. Wacyra
*Attorney, Agent, or Firm*—Brown & Martin

[57] ABSTRACT

A self-contained pouring spout which can be attached to a container over a single opening in the container. The structure includes a spout which is attached to the side of a container by a hinged tab and swings in and out through an opening in the container. The spout is controlled by a slide plate mounted in a guide channel, which is fixed on top of the container above the opening, the slide plate being connected to the spout by flexible straps on opposite sides, leaving a dispensing opening between the straps. A detent on the slide plate and guide channel holds the spout in closed position, and a finger pad is provided on the slide plate for positive grip and to make the spout action a one hand operation.

8 Claims, 5 Drawing Figures

POURING SPOUT ATTACHMENT FOR A CONTAINER

BACKGROUND OF THE INVENTION

Pouring spouts are used on a great many types of containers for a variety of products and take many different forms. Usually a small chute-like spout is hinged to a side of a container and swings out to expose an opening, the spout having a tab which is engaged by a fingernail to pull the spout out. This requires a two handed operation, hand to hold the container and the other to open the spout.

Other types use sliding members with perforations or openings which are selectively aligned with an opening in the container, various trap doors and panels, or complex mechanisms which operate elaborately folded spout structures. Many of the simple spouts involve tear strips incorporated in the container, which do not always tear properly and thus make the spout inefficient.

SUMMARY OF THE INVENTION

The pouring spout described herein is a self-contained unit which can be attached to a variety of containers, a single opening being required in the container for the spout to retract into. The spout has a hinge tab which is secured to the container below the opening, so that the spout can swing into and out of the opening. A guide channel is fixed to the top of the container above the opening and a slide plate, slidable in the channel, is connected to the spout by flexible straps on the opposite sides, leaving a dispensing opening between the straps. The slide plate has a detent which engages a corresponding detent on the guide channel to hold the spout closed. On the top of the slide plate is a fingerpad which provides a secure grip for operating the spout. On most containers which can be held in one hand, the spout action is a single hand operation, the spout being opened or closed by a finger of the hand holding the container.

The structure is very simple, the spout and slide plate being made from a single flat blank of plastic, cardboard, metal, or the like and the guide channel being an extrusion or folded from sheet material.

The primary object of this invention, therefore, is to provide a new and improved pouring spout attachment for a container.

Another object of this invention is to provide a pouring spout attachment which can be used on a variety of existing containers, requiring only a single opening in the container.

Another object of this invention is to provide a pouring spout attachment which can be made as a separate unit and attached to a container.

A further object of this invention is to provide a pouring spout attachment which can be actuated by one finger of a hand holding the container.

Other objects and advantages will be apparent in the following detailed description, taken in conjunction with the accompanying drawing, in which.

DESCRIPTION OF THE PREFERRED EMBODIMENT

Figure 1:
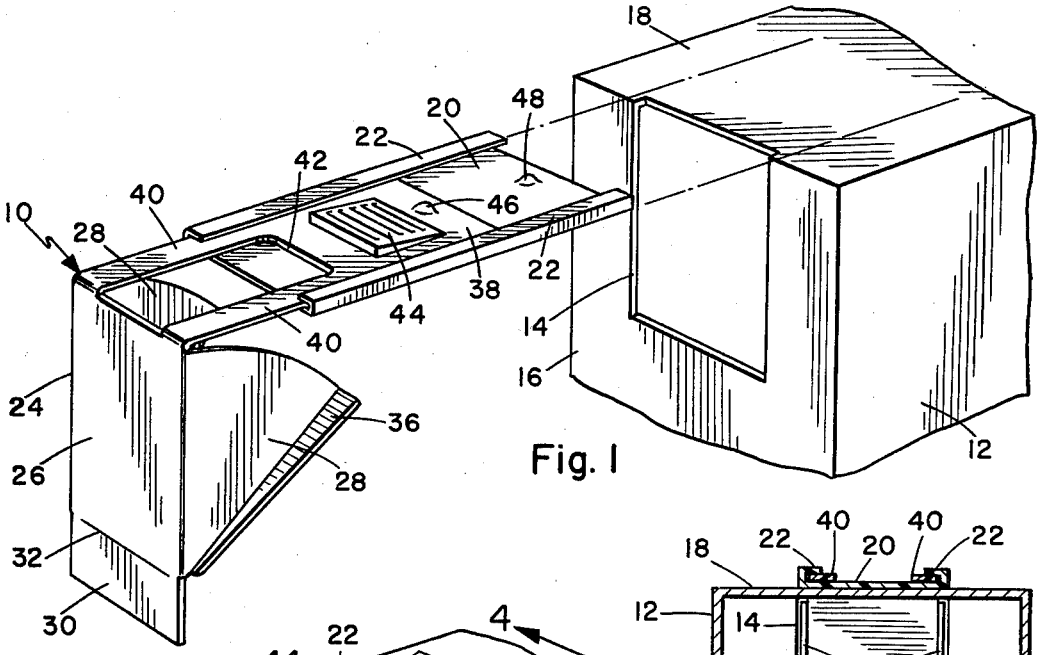
FIG. 1 is a perspective view showing the spout unit separated from a container.

The spout unit 10 is a self-contained structure which is attached to a container 12, the container having a rectangular opening 14 in one side 16, extending downwardly from the top 18. No other preparation or modification of the container is necessary.

The spout unit 10 includes an elongated inwardly turned, opposed longitudinal flanges 22 and is secured to the container top 18 by suitable adhesive, in alignment with the opening 14. The guide channel may be of plastic, metal, cardboard, or the like and could be extruded or folded from sheet material.

The spout 24 has a front wall 26 with rearwardly extending, generally triangular side walls 28, making a spout of U-shaped cross section. At the lower end of front wall 26 is an extended hinge tab 30, by which the spout is secured to the container side 16 immediately below opening 14. Side walls 28 extend into the container, the spout 24 being a close fit through opening 14. The side walls 28 diverge from the hinge line 32 at the hinge tab 30 and the upper edges 34 of the side walls are arcuate to clear the inside of top 18 as the spout swings in and out. To limit the outward extension of the spout, the rear edges of side walls 28 have outwardly turned stop flanges 36, which engage the inside of side 16 on opposite sides of opening 14.

Mounted in guide channel 20 is a slide plate 38, slidably held under flanges 22. The forward end of slide plate 38 has longitudinally extending straps 40 on opposite sides, the straps being connected to the upper edge of front wall 26 of the spout. The space between the straps 40 forms a dispensing opening 42. On the rear portion of slide plate 38 is a raised finger pad 44, which is serrated or textured in any suitable manner to provide a grip surface. Also on the rear portion of the slide plate 38 is a raised detent 46, which engages a similar detent 48 on guide channel 20 to hold the slide plate and spout 24 in the closed position.

The slide plate 38, straps 40 and spout 24 can be stamped, or otherwise produced from a unitary blank of sheet material. Finger pad 44 can be attached as a separate piece, or pressed into the slide plate, in which case the structure would be composed of only two parts for simplicity and economy of manufacture.

Figure 5:
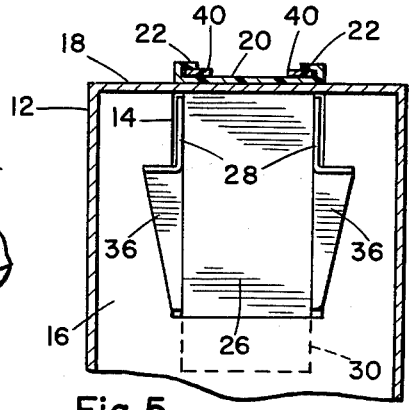
FIG. 5 is a sectional view taken on line 5—5 of FIG. 4.
Figure 2:
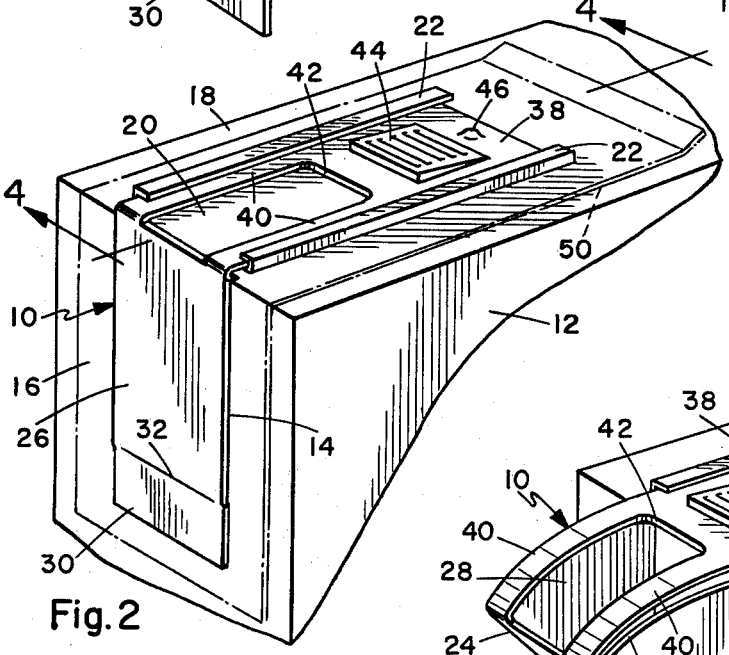
FIG. 2 is a perspective view of the spout mounted on the container in closed position.
Figure 4:
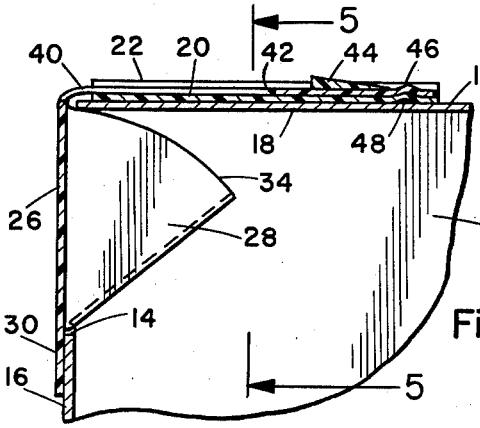
FIG. 4 is a sectional view taken on line 4—4 of FIG. 2.

In the closed position of the pouring spout, illustrated in FIGS. 2, 4 and 5, the spout 24 completely closes opening 14, with front wall 26 substantially flush with side 16. Slide plate 38 is locked in the rearward position by detents 46 and 48, and dispensing opening 42 is closed by the guide channel 20 and top 18. For security in storage and shipping, a tear strip 50, indicated in broken line in FIG. 2, may be secured to the container in any suitable manner over the complete spout installation.

Figure 3:
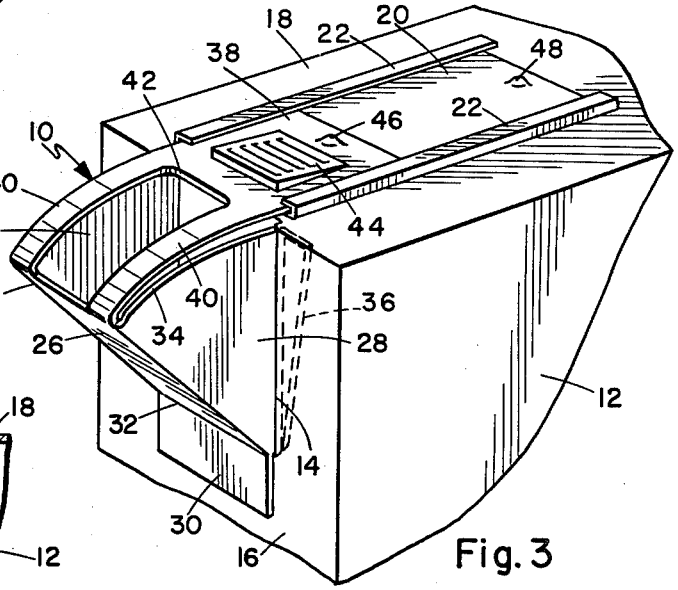
FIG. 3 is a perspective view showing the spout open.

To open the spout, finger pad 44 is engaged by a finger of the hand holding the top portion of the container and slide plate 38 is pushed forward, detent 46 riding over detent 48. Straps 40 push on front wall 26 and swing the spout 24 out, as in FIG. 3. The spout can be partially or fully opened as required and, if the friction of slide plate 38 in guide channel 20 is sufficient, will remain at any set position. Contents of the container can then be poured out through opening 14 and dispensing opening 42.

The pouring spout is particularly suitable for dispensing food products from various cartons and containers, but can be used for hardware or small parts of any type which will pass readily through the spout. The size of the spout and the materials from which it is made will depend on the type of product to be dispensed.

Having described my invention, I claim:

1. A pouring spout attachment for a container having a side, a top and a spout receiving opening in the side extending downwardly from the top, the spout attachment comprising:

a spout of generally U-shaped cross section having a hinge tab for attachment to the container side below the opening therein, with the spout extending through and being a close fit in the opening;

a slide plate having means for slidable mounting on the container top adjacent the opening and having connecting means coupled to said spout to open and close the spout by sliding motion of the slide plate.

2. A pouring spout attachment according to claim 1, wherein said means for slidable mounting comprises an elongated guide channel fixed to the container top, said slide plate being longitudinally slidable in said guide channel.

3. A pouring spout attachment according to claim 2, wherein said connecting means comprises a pair of straps extending longitudinally from said slide plate and defining a dispensing opening therebetween.

4. A pouring spout attachment according to claim 3, wherein said spout has a front wall with side walls extending rearwardly therefrom, said front wall substantially filling the container opening in a closed position of the spout and said hinge tab extending downwardly from the lower end of the front wall.

5. A pouring spout attachment according to claim 4, wherein the rear edges of said side walls have outwardly projecting stop flanges for engagement with the container side in the open position of the spout.

6. A pouring spout according to claim 5, wherein said slide plate, said straps and said spout are formed from a unitary piece of sheet material.

7. A pouring spout according to claim 3, and including a raised finger engaging pad on said slide plate.

8. A pouring spout according to claim 7, wherein said slide plate and said guide channel have corresponding detent means interfitting in the closed position of the spout.

* * * * *